US005647059A

United States Patent [19]

Uglene et al.

[11] Patent Number: 5,647,059

[45] Date of Patent: Jul. 15, 1997

[54] INFLATABLE NECK SEAL

[75] Inventors: Wendell Vaughn Uglene, Burnaby; Donald Mah, Richmond, both of Canada

[73] Assignee: M.E.T.A. Research Inc., Richmond, Canada

[21] Appl. No.: 257,241

[22] Filed: Jun. 8, 1994

[51] Int. Cl.[6] ..... B63C 11/04; A41D 13/00

[52] U.S. Cl. ..... 2/2.15; 2/2.17

[58] Field of Search ..... 2/2.15, 2.17, 69, 2/79, 123, 127, 128, 135

[56] References Cited

U.S. PATENT DOCUMENTS 4,365,351 12/1982 Doerschuk et al. ..... 2/2.15

5,136,721 8/1992 Farnworth .

FOREIGN PATENT DOCUMENTS 2277433 11/1994 United Kingdom ..... 2/2.15

*Primary Examiner*—C. D. Crowder
*Assistant Examiner*—Gloria Hale
*Attorney, Agent, or Firm*—C. A. Rowley

[57] ABSTRACT

An encircling sealable closure such as a neck band or collar made of a band of compressible material interposed between a three layer inflatable band at the neck of the user provides a neck seal by inflation of the inflatable band positioned between the compressible material and a substantially non-extendable outer wall. Inflation of the inflatable band deforms the compressible material to conform with and surround the neck of the wearer preventing the ingress of water past the neck seal so formed.

20 Claims, 2 Drawing Sheets

INFLATABLE NECK SEAL

FIELD OF THE INVENTION

The present invention relates to an encircling seal forming cuff, more particularly the present invention relates to a sealable collar structure particularly suited for use in an immersion suit.

BACKGROUND OF THE PRESENT INVENTION

U.S. Pat. No. 5,163,472 issued Aug. 11, 1992 to Farnworth et al. discloses an immersion suit having a particular collar structure formed by a band of compressible material encircling the neck of the wearer and forming a seal there around by tightening of a strap around the outside circumference of the collar to force the compressible material toward the neck of the wearer and form the seal.

In this suit, the collar is split, i.e. opens as does the front of the immersion suit by means of a reclosable fastener and provides a waterproof seal when closed. This structure has been proven satisfactory in use, however, it requires the presence of an outside strap and buckle and the threading of the strap through the buckle before a seal around the neck could be produced. Thus, where the suit was being worn open for comfort and if an emergency arises it may be necessary to rapidly and/or under adverse conditions close the front of the suit and then tighten the outside strap against the buckle to obtain the required protection. This is time consuming and in some cases, awkward, since the buckle is located under chin out of the view of the user. The tension applied around the neck need not be uniform which may lead so some discomfort to the user and an imperfect seal.

BRIEF DESCRIPTION OF THE PRESENT INVENTION

It is an object of the present invention to provide an improved system for providing a neck seal suitable for use in an immersion suit.

Broadly, the present invention relates to an encircling seal forming cuff structure for an immersion suit comprising a band of compressible material shaped with an outer circumferential surface and an inner circumferential surface said inner circumferential surface being shaped to in a compressed condition form a seal with a portion of a wearer encircled by said cuff, an inflatable band substantially encircling said band of compressible material, said inflatable band having an outer circumferential wall member limiting outward expansion of said inflatable band and an inner circumferentially extending wall member, said inner and outer wall members forming there between an inflatable chamber extending along said outer circumferential surface, an intermediate wall formed of flexible material defining a partition along the circumferential length of said chamber, a first securing means for securing said intermediate wall to said inner wall in a first set of first discreet securing strips spaced circumferentially of said cuff and a second securing means securing said intermediate wall member to said outer wall member in a second set of second discreet securing strips spaced circumferentially of said cuff, strips of said first and said second sets extending transverse to said circumferential length of said chamber and alternating circumferentially around said cuff and means for inflating said chamber.

Preferably, said intermediate wall will extend across substantially the full width of said chamber and will be secured to said inner and outer wall members along a pair of opposed walls of said chamber.

Preferably, said compressible material will comprise a closed-cell foam.

Preferably, said inner surface will be uneven and be formed by a plurality of discrete cavities formed by cells of said closed cell foam.

Preferably, adjacent axial ends of said strips positioned adjacent to one of said pair of opposed walls are spaced from said one wall to provide a circumferential rib forming passage extending circumferentially of said cuff adjacent to said one of said pair of opposed walls.

Preferably axial ends of said strips will be spaced from their respective adjacent of said opposed walls of said chamber to provide a circumferential rib forming passage extending circumferentially of said cuff between said ends of said strips and their adjacent of said pair of opposed walls.

Preferably, said first set and said second set of strips will be uniformly spaced about the circumference of said collar with said strips of said second set positioned midway between said strips of said first set.

Preferably said cuff comprises a collar for encircling the neck of a wearer.

Preferably, said strips of said first and second sets will be spaced from adjacent strips of their respective sets by a distance of between 3 and 6 centimeters, more preferably by a distance of between 4 and 5 centimeters.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
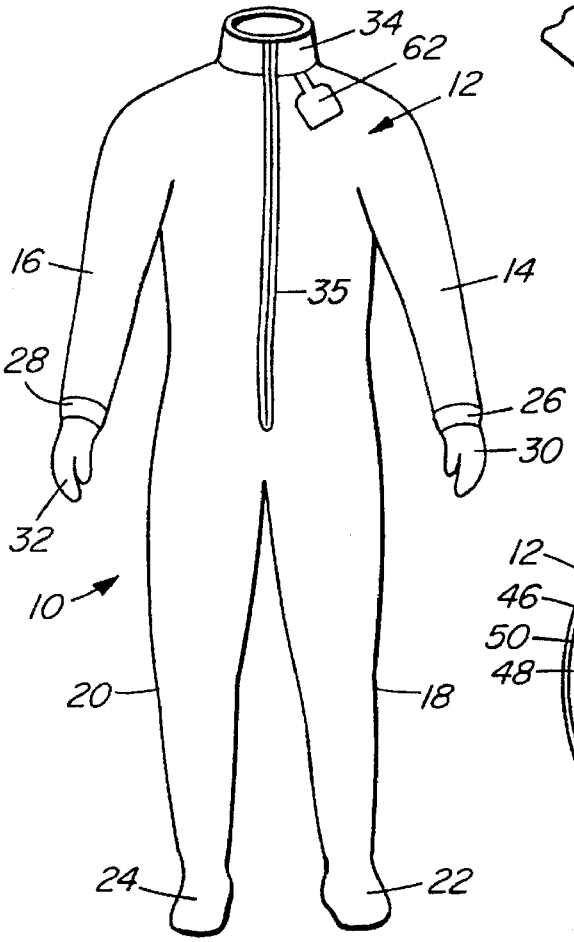
FIG. 1 is a illustration of an immersion suit incorporating the present invention.

As shown in FIG. 1, the suit 10 is comprised a body portion 12 having arms 14 and 16, legs 18 and 20 and integral feet 22 and 24. The arms 14 and 16 are each provided with suitable sealing cuffs, 26 and 28, or alternatively, the hands may be sealed by mitts, 30 or 32, and/or the wrist seals 26 and 28.

A collar portion 34 forms a particular type of cuff that is particularly adapted to encircle the neck and provide a seal as will be described in more detail herein below.

The body portion 12 and collar 34 in the illustrated arrangement may be opened via a suitable waterproof seal such as a waterproof zipper or the like as indicated at 35.

The body portion is preferably formed of suitable waterproof material that is flexible so that the wearer's mobility is not significantly hindered and may or may not be provided with a lining and suitable insulation.

The collar 34 which forms the basis of the present invention is shown in more detail in the remaining Figures.

Figure 2A:
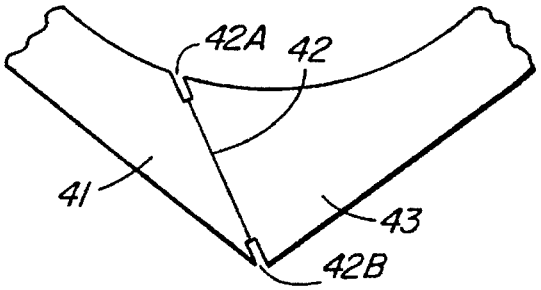
FIG. 2A is an enlarged view of a portion of the resilient ring of the collar structure shown in the preferred shape adjacent to the access opening of the collar.
Figure 2:
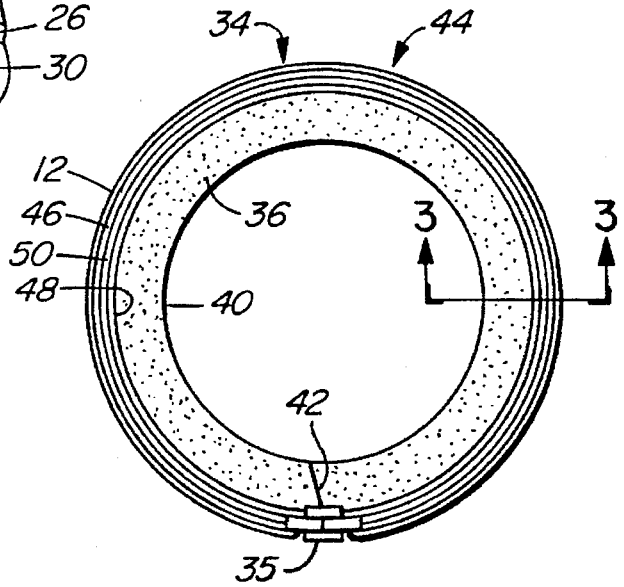
FIG. 2 is a view looking down into the collar of the present invention.
Figure 3:
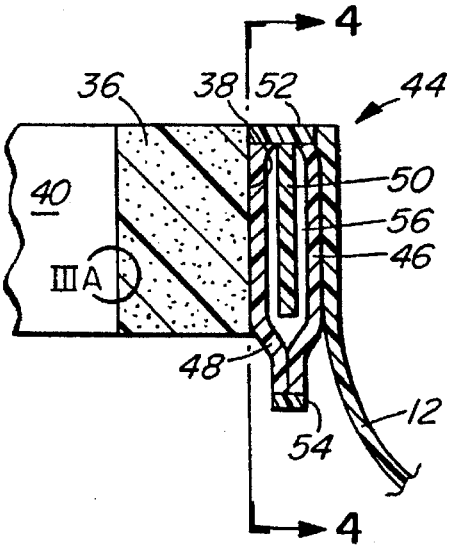
FIG. 3 is a section along the line 3—3 of FIG. 2 illustrating one embodiment of the present invention.
Figure 3A:
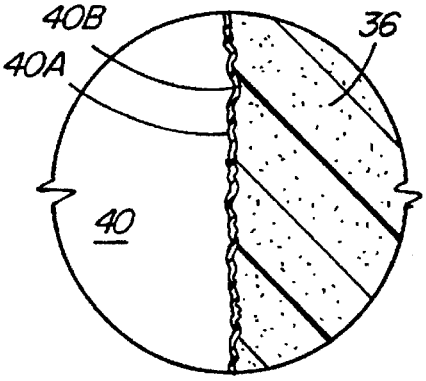
FIG. 3A is an enlarged view of a portion of the inner surface of the resilient ring of the collar structure.

As shown in FIG. 2, the neck or collar portion 34 of the cuff is formed by an internal band 36 of suitable flexible material which will normally be closed cell foam preferably, a closed cell polyvinyl chloride (PVC) foam having a compression strength suitable so that significant deformation of one side of the foam band 36 eg. the outer surface 38 of the foam 36 will also deform the inner surface 40 of the foam 36, i.e. pressure applied on the outer surface 38 to deform the outer surface 38 will be transmitted to and will also deform the inner surface 40 in an amount to reduce the size of the neck opening and apply pressure around the neck of the wearer sufficient to form a liquid (water) impermeable seal i.e. a watertight seal.

The foam ring 36 is split as indicated at 42, adjacent to the waterproof zipper or the like 35 and forms a water proof seal along the line 42 when the zipper 35 is fully closed. The ring 36 has a substantially circular inside surface 40 and its outer surface will normally be substantially concentric with the inner surface 40 except adjacent to the split 42 where the radial thickness of the ring 36 is increased as indicated at 41 and 43 i.e. the outer surface extends at a tangent to form the thickened portions 41 and 43. These portions 41 and 43 cooperate when the zipper 35 is closed to apply pressure from the walls of the garment and zipper 35 against the thickened portions 41 and 43 to close the silt 42 and better ensure a seal is formed.

The ring 36 preferably is made by cutting from a sheet of foam of the proper thickness a ring 36 having the desired external shape around its outside circumference (outer circumferential surface) and its inner circumferential surface 40. The radial thickness of the wall or ring 36 will as above indicated be substantially uniform except in the areas or portions 41 and 43 on opposite sides of the slit 42.

Cutting to form the inner circumferential surface from a sheet preferably of closed cell foam exposes the foam cells on the cut surface to provide an uneven surface with a plurality of side by side discrete cavities 40A of a size determined by the cell size in the foam. These cavities will generally be of a size so that compression from the outside of the ring 36 to reduce the diameter formed by the inner surface 40 and for a seal around the wearer's neck (or other appendage around which the cuff is portioned), causes deformation of the cavity walls 40A and the inner surface to more easily conform to and form a seal with the wearer as it reduces the tendency for the inner surface to buckle or form creases that might provide passages for water and thereby permit leakage.

Preferably this inner surface will have a protective coating 40B which will substantially conform to the contours of the uneven surface 40. The coating 40B must also be sufficiently flexible to deform with the surface 40 and form the desired seal.

The thickness of the foam sheet or slap from which the collar or ring 36 is cut determines the axial length of the ring or collar along the neck or the like of the wearer. It has been found that if this length is too long or too short difficulty may be encountered in forming a seal and/or the comfort of the wearer may be impaired. A thickness of 4 centimeters (cm.) has been found satisfactory, however, it is believed thicknesses of between about 2 and 8 cm. will in some circumstances be found satisfactory.

Positioned in substantially surrounding relationship to the resilient foam collar ring 36 is an inflatable band 44 formed of three layers of material, namely; an inner wall 46, an outer wall 48 and an intermediate wall 50. These three walls are preferably laminated together by suitable longitudinally extending welds or the like indicated at 52 and 54 which form a pair of opposite walls (top and bottom walls respectively) of an inflatable chamber 56 in band 44. (In at least one embodiment the intermediate wall does not form part of one of the seals or walls 52 or 54.) These walls or seals 52 and 54 extend the full effective length of the walls 46 and 48 defining the outer and inner sides of an inflatable chamber 56 i.e. extend from adjacent one side of the separation line or split 42 to adjacent the other side of the separation line 42 i.e. substantially circumferentially of the collar 34.

The axial ends of the chamber 56 are sealed by suitable transverse weld (not shown) to seal the chamber 56 except for the air inlet formed in a laterally (downwardly) projecting portion sealed around three sides but open to the interior of the chamber 56.

The intermediate layer 50 is welded or otherwise secured to the inner wall 48 by a first set of spaced welds or securing strips each indicated at 58 and to the outer wall 46 by a second set of spaced welds or securing strips 60.

The spacing between adjacent welds 58 in the first set of welds designated as dimension d is essentially the same as the spacing between adjacent welds of the second set of welds 60 again, as designated by the dimension d. Preferably, the distance between adjacent welds 58 and 60 circumferentially of the collar is equal to d/2.

The dimension d will normally be in the range of 3 to 6 centimeters (cm.), preferably, 4 to 5 cm. In one constructed model of the invention the dimension d was 4.4. cm. and the spacing between adjacent welds was d/2 or 2.2 cm.

The spacing S between the welded seam or wall 52 and the adjacent ends of the welds or strips 58 and 60 is preferably equal to the distance or spacing s between the weld seam or wall 54 and the ends of the welds 58 and 60 adjacent thereto. The length 1 of the welds 58 and/or 60 measured transverse to the band 44 (i.e. axially) is preferably at least 50% of the width W of the chamber 56 measured transverse to the band 44 and the spacings S and s will normally each be at least 5% of with W. The relative distances 1, S and s together with the distance d for a given material of construction define the shape of the bladder or band 44 when inflated.

The spaces S and s provide circumferentially extending rib forming passages (relative to the neck of the wearer) that facilitate movement of air to inflate or deflate the band 44. As will be described below the spaces S and s tend to define circumferentially extending ribs 61 and 63 (see FIG. 5) adjacent to the top and bottom (pair of opposed walls) of the band 44 which in the illustrated arrangement has a width substantially equal to the width of the foam band 36 so that these ribs apply pressure to the collar 36 around the circumference of the band or collar 36 adjacent to the axial ends of the collar 36.

The welds or strips 58 and 60 as above described are centered in and extend only part way across the chamber 56 in the illustrated embodiments which is the preferred structure of the welds 58 and 60.

Figure 4:
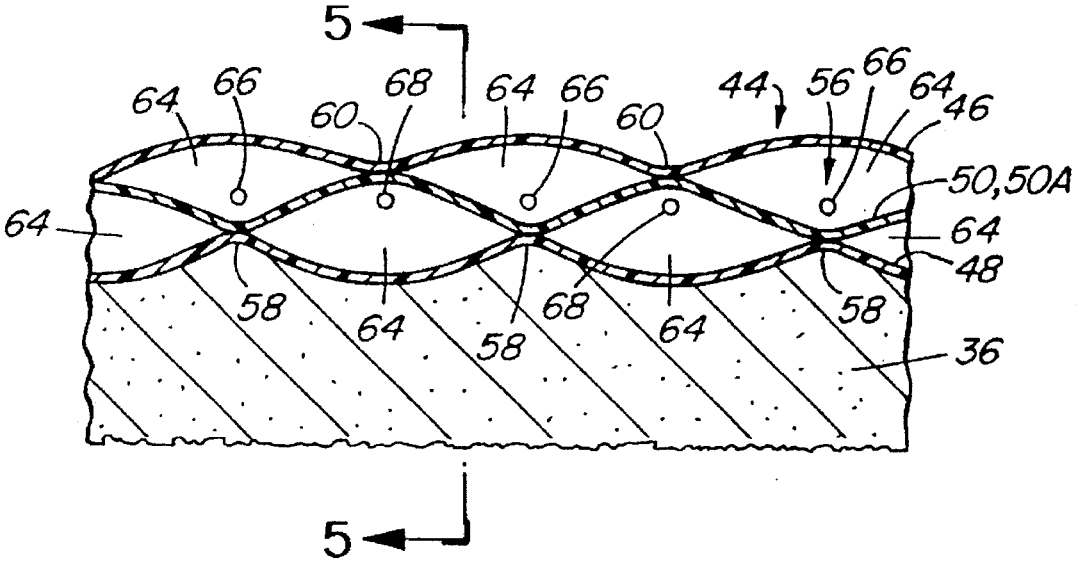
FIG. 4 is a schematic illustration of the present invention in inflated seal forming condition based on a longitudinal section through the seal.
Figure 5:
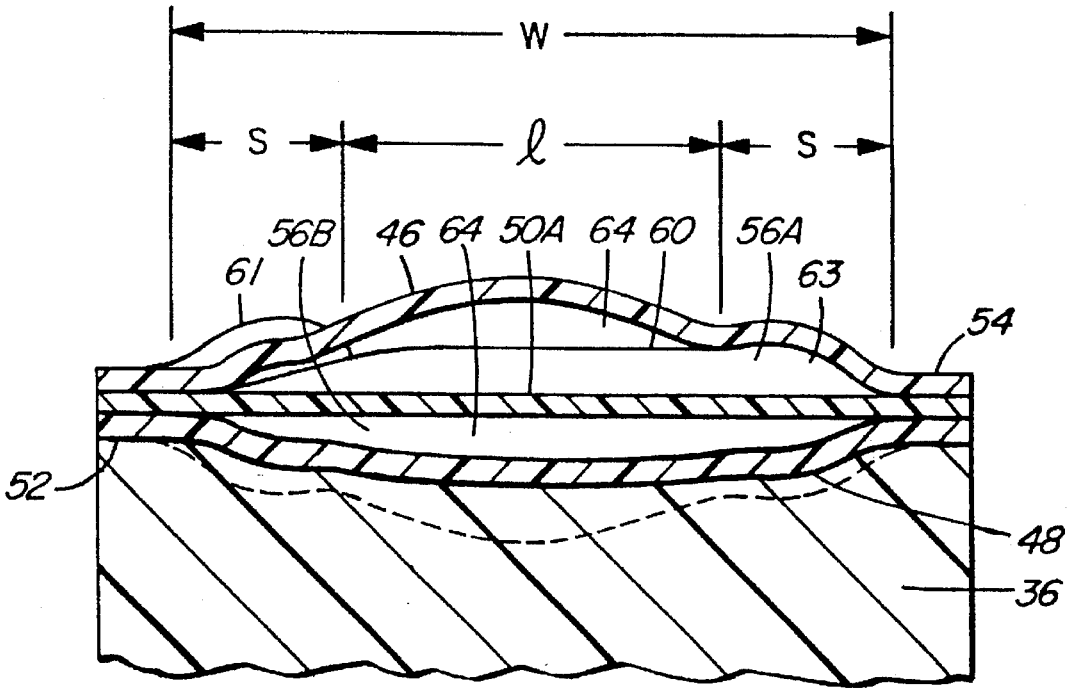
FIG. 5 is a section along the line 5—5 of FIG. 4.

In the preferred embodiment shown in FIGS. 4 and 5 the intermediate wall 50A extends completely across the chamber 56 and divides the chamber 56 into two separate compartments 56A and 56B. The compartments 56A are interconnect by the passages formed by the spaces S and s on one side of the intermediate wall 50A and the compartments 56B by similar passages on the other side of the wall 50A.

The wall 50 or 50A may be made with passages eg. a porous material to facilitate the movement of air there through.

It is preferred that the intermediate wall 50 or 50A be made of a film material that is more easily stretched than the two walls 46 and 48 so that on inflation the intermediate wall 50 or 50A is stretched more than the walls 46 or 48. The outer wall 48 (48A) is reinforced by the material of the garment shell as indicated at 12 and stretches little, if any, on inflation of the bladder 56 (56A) while as above indicated the inner layer 46 is stretched only slightly, preferably significantly less than the intermediate layer 50 (50A) and less than the outer layer 48.

In a preferred construction the dimensions W=3 cm; I=2 cm and S=s=0.5 cm has been found satisfactory. It is believed that these dimensions may be decrease slightly eg. W=2.5 cm and the other dimensions changed accordingly or increased more significantly eg W=4 cm, but as above indicated, if the band and thus the collar are made too small attaining a proper seal may be difficult and if the band and collar are too wide the neck opening may make the wearer uncomfortable.

It will be apparent that the compartments 64 shown in FIG. 5 will be discreet compartments if the intermediate layer or wall 50A seals them off i.e. the intermediate wall 50A is impermeable and the seals or welds 58 and 60 extend completely across the chamber 56. This structure could be used in a special design using two separate manifolds one having separate inlets 66 one leading into each compartment 64 on the side of the panel 50A adjacent the outer layer 46 and the other having separate inlets 68 one leading into each compartment 64 between the layer 50A and the inner layer 48 so that a different pressure may be applied to opposite sides of the intermediate layer 50A or if one of the bladders i.e. one side of the intermediate wall becomes broken the either side may still be in tack and provide the compression required to form a seal. This arrangement is not preferred for several reasons, not the least of which is the fact that the welds or strips 58 and 60 extend fully across the bladder or band 44 the ribs 61 and 63 hereinafter described would be eliminated.

The inflatable band 44 may be inflated by any suitable system as schematically indicated at 62 in FIG. 1. This means 62 which may be positioned in any suitable location on the garment may take the form of a cartridge such as a $CO_2$ cartridge or the like, or a valved tube to permit inflation by mouth or a pump or several of these alternatives may be provided and the choice left to the user.

When air (or other gas) is pumped into the chamber 56, each of the pockets 64 into which the chamber 56 is divided by the intermediate member 50 is inflated to form a plurality of interconnected pillow-shaped pockets that apply pressure to the foam 36 to reduce the inside diameter of inner wall 40 of the chamber 56 to close the foam collar or ring 36 about the neck and form a seal.

It will be apparent that maximum pressure is applied to the outer surface 38 of the foam 36 at the mid-point of the inner wall 48 between pairs of adjacent welds 58 with lesser pressure being applied in the area corresponding to the welds 58. This arrangement better ensures that there is no buckling of the foam collar 36 along the inner face 40 and better ensures a good seal around the full circumference of the neck.

As shown in FIG. 5 when the bladder or band 44 is inflated an upper and a lower rib 61 and 63 respectively is formed by the spaces S and s respectively to aid in providing the circumferential seal about the neck of the wearer.

Obviously, the strength of the outer layer 46, i.e. the amount that it stretches under pressure and the amount the inner wall 48 stretches as well as the stretch of the intermediate wall 50 all contribute to the final shape of the pillow chambers or compartments 64. Applicant has found that the tensile strength of the inner, outer and intermediate layers 48, 46 and 50 respectively as above indicated will preferably be correlated to ensure that neither of the layers 46 and 48 stretch significantly under the pneumatic pressures applied and the layer 50 or 50A may be weaker than the layers 46 and 48 to stretch as desired to apply the required pressure. Obviously the material to which the layers 46 and 48 are connected to may contribute to the required strength of these layers.

An air pressure of about 2 psig. applied within the bladder 56 (56A) has been found to be sufficient to form a seal in a garment constructed in accordance with the preferred embodiment.

It will be apparent that in use, the suit is closed by closing the closing device or zipper 35 which essentially seals the suit except around the collar 34 and the collar may be sealed at any convenient time (either before or after closing the zipper 35) by the means indicated at 62 to form a comfortable seal around the neck of the user.

When a pump or blow-up tube is used to inflate the inflatable chamber 64, the pressure may be selected to that comfortable for the user. Similarly the amount of gas applied by say a $CO_2$ container will be selected accordingly (2 grams of carbon dioxide has been found to be sufficient).

While the above disclosure has been directed specifically to a neck or collar seal it could also be used for sealing, for example, around an arm or a leg.

Having described the invention, modifications will be evident to those skilled in the art without departing from the scope of the invention as defined in the appended claims.

We claim:

1. An encircling seal forming cuff structure for an immersion suit comprising a band of compressible material shaped with an outer circumferential surface and an inner circumferential surface, said inner circumferential surface being shaped to in a compressed condition form a seal with a portion of a wearer encircled by said cuff, an inflatable band substantially encircling said band of compressible material, said inflatable band having an outer circumferential wall member limiting outward expansion of said inflatable band and an inner circumferentially extending wall member, said inner and outer circumferential wall members forming there between an inflatable chamber extending along said outer circumferential surface, an intermediate wall member formed of flexible material defining a partition along the circumferential length of said chamber, a first securing means for securing said intermediate wall member to said inner circumferential wall member with a first set of first discreet securing strips spaced circumferentially of said cuff and a second securing means securing said intermediate wall member to said outer circumferential wall member with a second set of second discreet securing strips spaced circumferentially of said cuff, strips of said first and said second sets of discrete securing strips extending transverse to said circumferential length of said chamber and alternating circumferentially around said cuff and means for inflating said chamber.

2. A cuff structure as defined in claim 1 wherein said intermediate wall member extends across substantially full width of said chamber and is secured to said inner and outer circumferential wall members along a pair of opposed walls at axial ends of said chamber.

3. A cuff structure as defined in claim 1 wherein said compressible material comprises a closed-cell foam.

4. A cuff structure as defined in claim 2 wherein said compressible material comprises a closed-cell foam.

5. A cuff structure as defined in claim 1 wherein said inner circumferential surface is uneven and is formed by a plurality of discrete, side by side cavities.

6. A cuff structure as defined in claim 2 wherein said inner circumferential surface is uneven and is formed by a plurality of side by side, discrete cavities.

7. A cuff structure as defined in claim 3 wherein said inner circumferential surface is uneven and is formed by a plurality of discrete cavities formed by cells of said closed cell foam.

8. A cuff structure as defined in claim 4 wherein said inner circumferential surface is uneven and is formed by a plurality of discrete cavities formed by cells of said closed cell foam.

9. A cuff structure as defined in claim 1 wherein adjacent axial ends of said strips positioned adjacent to one of said inner and outer circumferential wall members at an axial end of said chamber are spaced from said one of said inner and outer circumferential wall members to provide a circumferential rib forming passage extending circumferentially of said cuff adjacent to said one of said inner and outer circumferential wall members.

10. A cuff structure as defined in claim 2 wherein adjacent axial ends of said strips positioned adjacent to one of said inner and outer circumferential wall members at an axial end of said chamber are spaced from said one of said inner and outer circumferential wall members wall to provide a circumferential rib forming passage extending circumferentially of said cuff adjacent to said one of said inner and outer circumferential wall members.

11. A cuff structure as defined in claim 4 wherein adjacent axial ends of said strips positioned adjacent to one of said tuner and outer circumferential wall members at an axial end of said chamber are spaced from said one of said inner and outer circumferential wall members wall to provide a circumferential rib forming passage extending circumferentially of said cuff adjacent to said one of said inner and outer circumferential wall members.

12. A cuff structure as defined in claim 5 wherein adjacent axial ends of said strips positioned adjacent to one of said inner and outer circumferential wall members at an axial end of said chamber are spaced from said one of said inner and outer circumferential wall members wall to provide a circumferential rib forming passage extending circumferentially of said cuff adjacent to said one of said inner and outer circumferential wall members.

13. A cuff structure as defined in claim 6 wherein adjacent axial ends of said strips positioned adjacent to one of said inner and outer circumferential wall members at an axial end of said chamber are spaced from said one of said inner and outer circumferential wall members wall to provide a circumferential rib forming passage extending circumferentially of said cuff adjacent to said one of said inner and outer circumferential wall members.

14. A cuff structure as defined in claim 7 wherein adjacent axial ends of said strips positioned adjacent to one of said inner and outer circumferential wall members at an axial end of said chamber are spaced from said one of said inner and outer circumferential wall members wall to provide a circumferential rib forming passage extending circumferentially of said cuff adjacent to said one of said inner and outer circumferential wall members.

15. A cuff structure as defined in claim 2 wherein axial ends of said strips at each end of said strips are spaced from their respective adjacent of said inner and outer circumferential wall members to provide a circumferentially extending rib forming passage adjacent to each of said of said inner and outer circumferential wall members, said passages extending circumferentially of said cuff.

16. A cuff structure as defined in claim 4 wherein axial ends of said strips at each end of said strips are spaced from their respective adjacent of said inner and outer circumferential wall members to provide a circumferentially extending rib forming passage adjacent to each of said of said inner and outer circumferential wall members, said passages extending circumferentially of said cuff.

17. A cuff structure as defined in claim 6 wherein axial ends of said strips at each end of said strips are spaced from their respective adjacent of said inner and outer circumferential wall members to provide a circumferentially extending rib forming passage adjacent to each of said of said inner and outer circumferential wall members, said passages extending circumferentially of said cuff.

18. A cuff structure as defined in claim 1 wherein said first set and said second set of strips are uniformly spaced about the circumference of said cuff with said strips of said second set positioned midway between said strips of said first set.

19. A cuff structure as defined in claim 2 wherein said first set and said second set of strips are uniformly spaced about the circumference of said cuff with said strips of said second set positioned midway between said strips of said first set.

20. A cuff structure as defined in claim 17 wherein said first set and said second set of strips are uniformly spaced about the circumference of said cuff with said strips of said second set positioned midway between said strips of said first set.

* * * * *